United States Patent [19]

Hirnböck et al.

[11] Patent Number: 4,537,417

[45] Date of Patent: Aug. 27, 1985

[54] SKI, PARTICULARLY A CROSS COUNTRY SKI

[75] Inventors: Rudolf Hirnböck; Adolf Haudum, both of Hohenems, Austria

[73] Assignee: Kastle Gesellschaft m.b.H., Austria

[21] Appl. No.: 545,480

[22] Filed: Oct. 26, 1983

[30] Foreign Application Priority Data

Nov. 2, 1982 [AT] Austria ..... 3981/82

[51] Int. Cl.[3] ..... A63C 5/07

[52] U.S. Cl. ..... 280/602; 280/610

[58] Field of Search ..... 280/610, 602, 608, 609

[56] References Cited

U.S. PATENT DOCUMENTS

| | | | |
|---|---|---|---|
| 2,918,293 | 10/1957 | Tavi | 280/602 |
| 3,194,572 | 12/1961 | Fischer | 280/610 |
| 3,901,522 | 8/1975 | Boehm | 280/610 |
| 4,005,875 | 2/1977 | Bjertnaes | 280/610 |

FOREIGN PATENT DOCUMENTS

| | | | |
|---|---|---|---|
| 254749 | 5/1957 | Austria | 280/610 |
| 310052 | 9/1973 | Austria | 280/610 |
| 255731 | 2/1949 | Switzerland | 280/602 |

*Primary Examiner*—Joseph F. Peters, Jr.
*Assistant Examiner*—Everett G. Diederiks, Jr.
*Attorney, Agent, or Firm*—Anthony M. Lorusso

[57] ABSTRACT

A ski, particularly a cross-country ski, with a subdivided lower bearing sheet, with the individual sheet members of said lower bearing sheet extending in the longitudinal direction of the ski being overlapped and an elastic layer of elastic-viscous material being arranged in the overlapping portion of said sheet members between said overlapping sheet members.

5 Claims, 8 Drawing Figures

SKI, PARTICULARLY A CROSS COUNTRY SKI

BACKGROUND OF THE INVENTION

The invention relates to a ski, particularly a cross-country ski, comprising a subdivided lower bearing sheet absorbing the occurring tensile stresses.

DESCRIPTION OF THE PRIOR ART

In cross-country skiing there are two alternating phases in the motion of the cross-country ski with respect to the snow surface; the sliding phase and the pushing-off phase. The cross-country ski should, on the one hand, slide well on the snow surface during the sliding phase, and, on the other hand, it should direct the pushing-off force occurring during the pushing-off phase into the ground without the cross-country ski sliding on the snow surface against the direction of forward motion. It has been tried to meet these very complex demands by a special structure of the sliding surface (scales, fur-like strips etc.) or by waxing the sliding surface, on the one hand, and by special constructions of the ski body, on the other hand.

These measures, however, are only a compromise solution to meet the demands for good slideability during the sliding phase and good adhesion during the pushing-off phase.

To obtain more rigidity in the center portion of the ski conventional sheet arrangements, which as a rule comprise single-layer continuous sheet elements, are in said portion provided with a second reinforcing layer which is rigidly and adhesively affixed to the sheet elements. A construction of this kind has, for example, been described in Austrian Pat. No. 254,749 in which metal inserts in the region of the pushing-off portion reinforce a ski body of plastics material. As used herein, and as is well known in the art, the pushing off portion of a cross-country ski is a section extending across the entire width of the ski and extending longitudinally over approximately one-third of the length of the skis, extending for approximately equal lengths forward and rearward from the location of the binding attachment. When no load is applied to the ski, the pushing-off portion of the ski assumes a so-called secondary camber, a curvature which is concave toward the sliding surface. Subdivided lower bearing sheets, as shown in Swiss Pat. No. 255,731, also belong to the state of the art. The sheet elements of the lower bearing sheet described therein serve only for the absorption of tensile stresses in Alpine skis and are, hence, not suitable for cross-country skis. Moreover, a ski with a reinforcing strip arranged over the major part of the ski length is known from Austrian Pat. No. 310,052, said strip engaging in the region of the shovel and the rear ski end in broader reinforcing plates for the purpose of adapting the relation between the torsion resistance and the bending resistance to the requirements of an Alpine ski in particular.

In a cross-country ski, however, a special distribution of rigidity and the so-called secondary camber, which lies in the region of the pushing-off portion and effects a reduction of pressure between snow and ski during the sliding phase, effect the essential features of cross-country behaviour.

If, for example, the rigidity is to high, the pushing-off force required to provide good contact between snow and ski coating in the region of the pushing-off portion gets too great, and it appears to the skier that the sliding surface of the ski is too smooth. If the chamber is too small and rigidity too low, the frictional force increases in the sliding phase.

SUMMARY OF THE INVENTION

It is, therefore, the object of the invention, to provide a cross-country ski which is, on the one hand, characterized by good sliding properties during the sliding phase and which, on the other hand, prevents downward sliding during the pushing-off phase.

According to the invention, this is achieved in that the individual sheet members of the lower bearing sheet which extend in the longitudinal direction of the ski substantially one after another, overlap one another in the direction normal to the sliding surface on the ski, and that at least in the region in which the sheet members overlap at least one elastic layer of elastic-viscous material is arranged between the overlapping sheet members. The elastic layers of elastic-viscous material may be of rubber or other elastomers, for example. The bearing sheet members may be of reinforced plastics material or metal, for example.

An overlapping sheet arrangement of this kind provides the possibility of a better compromise between the reduction of pressure during the sliding phase and the required pushing-off force during the pushing-off phase.

If, during the sliding phase, a maximal load of up to half of the skier's body weight acts on the ski, substantially no shear deformations occur in the elastic layers, and the length of the lower sheet remains substantially unchanged. Hence, the camber of the ski is not changed and the ski slides without the means (climbing wax, fur-like strips etc.), which are arranged in the pushing-off region of the coating and prevents backward sliding, touching the snow under pressure.

During the pushing-off phase a multiple of the skier's body weight acts on the ski for a short time. As a result, shearing forces occur in the elastic layers which exert stresses on the material of the elastic layers such that a progressive change in the length of the lower sheet takes place, and the camber is lost. During this time the means provided on the coating (climbing wax, fur-like strips etc.) and preventing backward sliding rest firmly on the snow, and backward sliding of the ski is prevented.

BRIEF DESCRIPTION OF THE FIGURES OF THE DRAWING

Various embodiments will now be described in detail by means of the drawings, in which.

DESCRIPTION OF THE PREFERRED EMBODIMENTS

Figure 1:
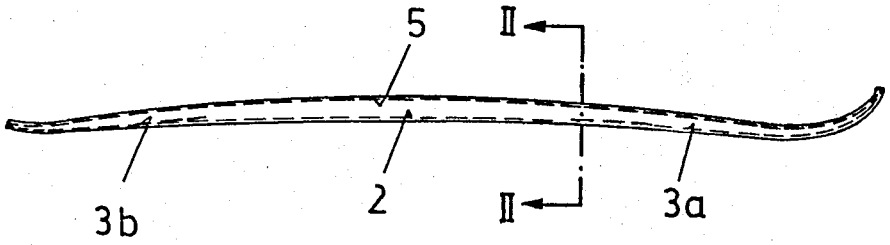
FIG. 1 shows a side view of a cross-country ski.
Figure 2:
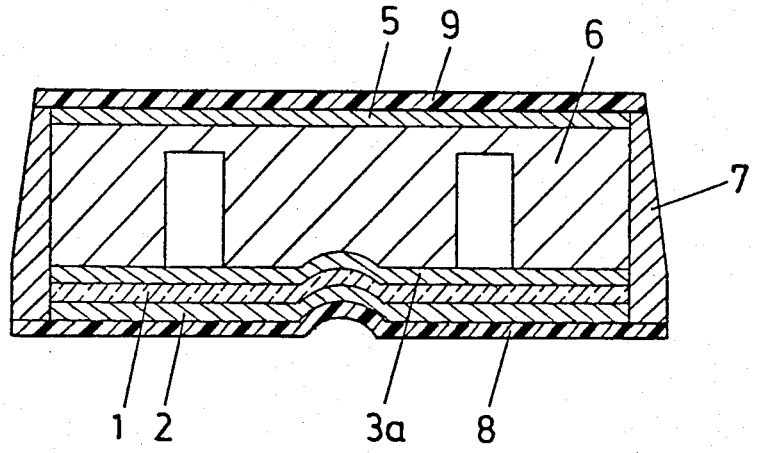
FIG. 2 shows a cross-section along II—II of FIG. 1, FIGS. 3 to 6 show a schematic longitudinal section of different embodiments of the lower sheet according to the invention.
Figure 3:
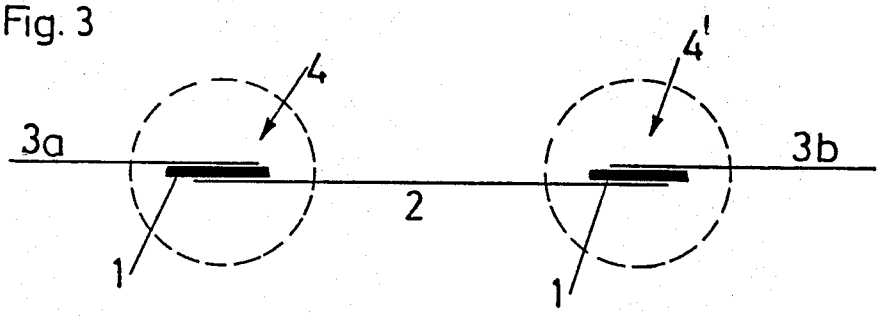
Figure 4:
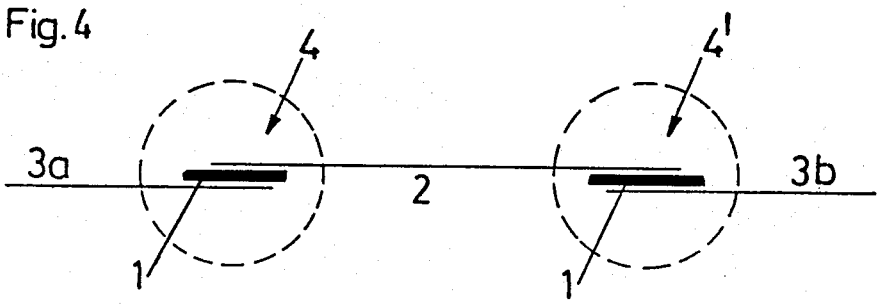

The cross-country ski according to FIGS. 1 to 3 comprises a lower bearing sheet with three sheet members 2, 3*a*, 3*b* and an upper bearing sheet 5 of glass fiber reinforced plastic. A light core, for example of foamed plastics material or light wood, is arranged between the upper bearing sheet and the lower bearing sheet. The sliding sole 8 and the upper face 9 are of plastics material. The side members 7 may, for example, be of wood or plastics material.

The structure of the lower bearing sheet comprising the three sheet members 2, 3*a*, 3*b* is schematically shown in FIG. 3, for example. Accordingly, in the overlapping portions 4, 4', which as substantially provided at the rearward and forward boundaries, respectively of the pushing-off portion arranged in the central part of the ski, the central sheet member 2 overlaps with an outer sheet member 3*a* and 3*b*. Between the overlapping sheet elements 2, 3*a*, 3*b*, each, elastic layers 1 are arranged which substantially absorb the tensile stresses occurring in the lower sheet, when load acts on the ski.

Figure 5:
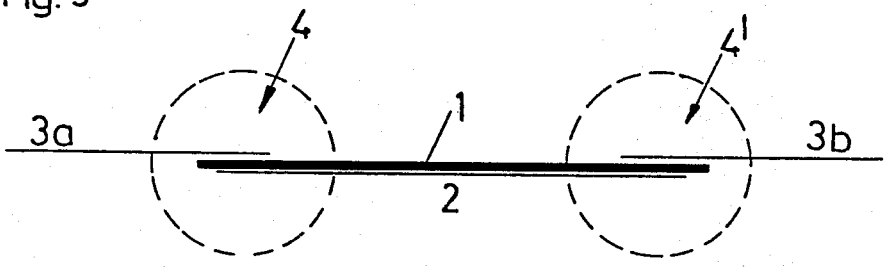

In the embodiment illustrated in FIG. 5 the elastic layer 1 extends beyond the overlapping portion 4 along the central sheet member 2 into the other overlapping portion 4'.

Figure 6:
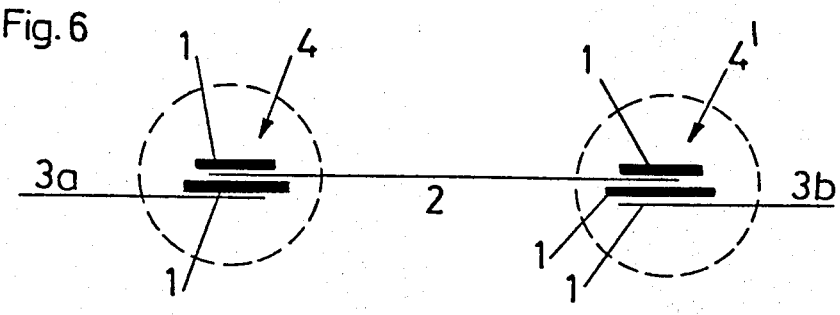

FIG. 6 shows an embodiment in which additional elastic layers 1 which do not lie between the sheet members 2, 3*a*, 3*b* are arranged in the overlapping portions 4, 4'.

Figure 7:
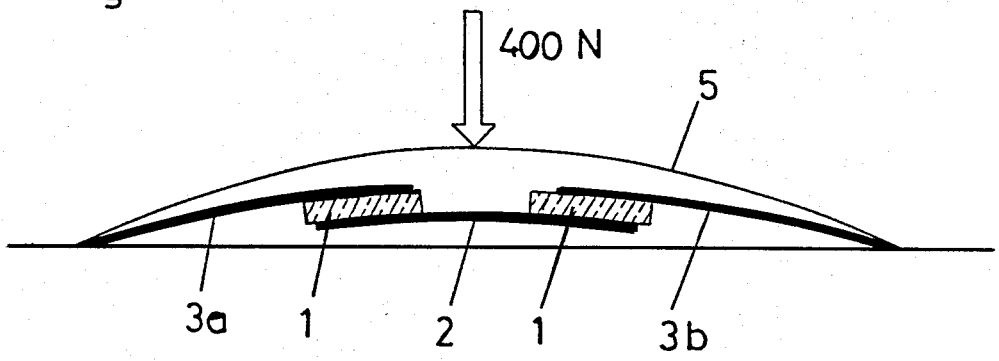
FIGS. 7 and 8 show a schematic longitudinal section of a sheet arrangement during the sliding and pushing-off phases.

FIG. 7 shows a sheet arrangement comprising upper bearing sheet 5 and lower bearing sheet, 2, 3*a*, 3*b* which is subdivided according to the invention and connected by elastic layers 1 in the overlapping portions. When a load corresponding to half of a skier's body weight of about 800N, i.e. a load of about 400N, acts on the ski, the thus created tensile forces in the lower sheet are not sufficient to effect intense shearing of the elastic layers 1. The lower sheet maintains its length, and the means provided on the ski coating which prevent backward sliding and are arranged substantially below the central sheet member 2 hardly get into contact with the snow.

Figure 8:
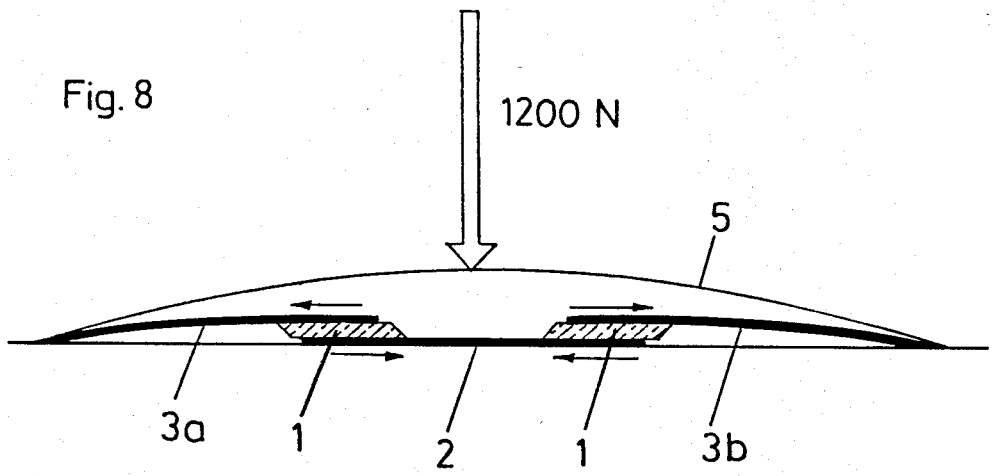

This is different in FIG. 8, in which during the pushing-off phase a substantially greater force, e.g. 1200N, acts on the ski. The elastic layers 1 are stressed up to their proportional elastic limit, and they shear progressively. Hence, the lower sheet 2, 3*a*, 3*b* elongates, and the means provided on the coating and preventing backward sliding firmly rest on the snow.

What is claimed is:

1. A cross-country ski, comprising a lower bearing sheet absorbing the occurring tensile stresses and being subdivided into at least two sheet members with each of said sheet members extending in the longitudinal direction over less than the whole length of the ski wherein the individual sheet members of said lower bearing sheet, extending in the longitudinal direction of the ski are substantially arranged one after the other and overlap one another in the direction normal to the sliding surface of the ski over less than their entire respective length, and wherein at least in the overlapping portions of said sheet members, between said overlapping sheet members at least one elastic layer of elastic-viscous material is arranged.

2. A ski as claimed in claim 1, comprising a pushing-off portion located centrally with respect to the long dimension of the ski, having forward and rearward boundaries, wherein said lower bearing sheet comprises three sheet members overlapping in the region of the forward and rearward boundaries of said pushing-off portion.

3. A ski as claimed in claim 1, wherein at least one elastic layer extends parallel to and at least over the total length of one of said sheet members.

4. A ski as claimed in claim 1, wherein part of said elastic layers are arranged in said overlapping portions above the upper-most overlapping bearing sheet member.

5. A ski as claimed in claim 1, wherein said elastic-viscous layers are of rubber or other elastomers.

* * * * *